US006446592B1

(12) United States Patent
Wilksch

(10) Patent No.: US 6,446,592 B1
(45) Date of Patent: Sep. 10, 2002

(54) INVERTED INTERNAL COMBUSTION ENGINE CONFIGURATION

(75) Inventor: Mark Conrad Wilksch, Bucks (GB)

(73) Assignee: Seneca Technology Limited (KN)

( * ) Notice: Subject to any disclaimer, the term of this patent is extended or adjusted under 35 U.S.C. 154(b) by 0 days.

(21) Appl. No.: 09/552,386

(22) Filed: Apr. 19, 2000

(30) Foreign Application Priority Data

Apr. 19, 1999 (GB) ..... 9908845

(51) Int. Cl.[7] ..... F01M 11/00
(52) U.S. Cl. ..... 123/196 R
(58) Field of Search ..... 123/196 R, 196 CP, 123/196 W, 195 C; 184/6.7

(56) References Cited

U.S. PATENT DOCUMENTS 1,889,290 A * 11/1932 Pirinoli
1,906,045 A * 4/1933 Chevrolet
1,941,974 A * 2/1934 Davis
2,306,554 A * 12/1942 Morehouse
4,117,907 A * 10/1978 Lechler
4,745,754 A * 5/1988 Kawamura ..... 60/608

FOREIGN PATENT DOCUMENTS

GB 552164 * 3/1943

* cited by examiner

*Primary Examiner*—Gene Mancene
*Assistant Examiner*—Hyder Ali

(57) ABSTRACT

An inverted aircraft internal combustion engine, such as a two-stroke, compression-ignition diesel engine, includes a wet sump lubrication system with a combined under-slung camshaft or valve gear cover and sump housing, as well as a turbocharger located above the wet sump operational oil level and lubricated from the wet sump system with gravity return to the sump.

16 Claims, 1 Drawing Sheet

INVERTED INTERNAL COMBUSTION ENGINE CONFIGURATION

TECHNICAL FIELD

The present invention relates to various aspects of internal combustion engine orientation, the disposition of engine ancillaries and their constructive combination, including a "wet sump" engine lubrication system and a turbocharger location, installation and lubrication for an inverted engine, in particular one configured for aircraft propulsion.

BACKGROUND

The diversity of (multi-)cylinder configurations, for (aircraft) piston engines, typically with a single common crankshaft toward the bottom of the engine, include, for example: (a) a single-file row (i.e. an "in-line" configuration); (b) multiple, discrete, "angularly-splayed", or angularly offset, "rows" (albeit there may be only one cylinder in each row) —such as a "V" or "W" configuration; (c) in rows opposed, either horizontally, vertically, or at some other angle (e.g. a "flat" configuration); and (d) individually, around a common crankshaft axis, generally equi-angularly spaced, in one or more planes (e.g. a "radial" configuration).

There also have been some engines with multiple crankshafts —for example, with cylinders arranged in an "H" configuration (in effect, two 'flat' engines, sharing a single common crankcase), or with two pistons per cylinder working in opposition in various "opposed-piston" arrangements.

It is known to invert an in-line, or "V" engine configuration so that the cylinders are below the crankshaft, which is thus toward the top of the engine. A prime advantage of such engine inversion, for aircraft propeller propulsion is that the crankshaft sits higher on the engine, and so a propeller mounted directly upon it will be farther from the ground. At critical flight phases of take-off and landing, it is important to maintain adequate clearance between the propeller and the ground. The object is to reduce the chance of accidental damage, allowing for undercarriage travel and fuselage forward tipping moment about the undercarriage.

Other ways to improve ground clearance include lengthening the undercarriage in order to raise the whole aircraft further from the ground, reducing the diameter of the propeller, and raising the engine installation in the aircraft. All of these have drawbacks, however. It is thus well-established for smaller aircraft that use directly-driven propellers (i.e. propellers mounted directly upon a crankshaft end), to use an inverted engine arrangement.

Engines that are not inverted, that is which have the crankshaft generally at the bottom of the crankcase and the cylinders generally upright or vertical with the cylinder heads uppermost (in the case of in-line engines), commonly have a wet sump lubrication system and rely upon a gravity return of a recirculatory lubricant (oil). More specifically, a lower part of the crankcase is typically extended to provide a reservoir (i.e. the sump) of lubricant (oil). Thus, in practice, a sump body or casing is commonly secured directly to part of the engine body, housing, or casing.

Alternatively, engines may have a dry sump lubrication system and rely upon a pumped recirculatory flow return of lubricant (oil) to a discrete reservoir. Thus, in practice, lubricant (oil) is typically drained away, partly (passively) under gravity, to one or more internal engine collection point(s). Collected (oil) then (actively) pumped (scavenged), or returned by some other positive displacement or pressuredifferential means, to a separate (oil) tank that serves as an (external) engine lubricant (oil) reservoir (i.e. outside an internal engine lubricant path). One dry sump arrangement (e.g. ROTAX™) uses ambient crankcase pressure to return used oil to an oil tank. Alternatively, the oil may drain naturally from the dry sump to a (separate) oil tank at a lower level. Also, radial engines are known in which "used" oil from each cylinder head, as well as the crankcase, is returned to a separate oil tank.

Hitherto, inverted aircraft engines have used a dry sump arrangement, that is with "used" oil being returned to a (discrete, dedicated) tank, disposed externally of the engine, by draining (passively) under gravity, and/or being (actively) drawn away by an oil (scavenge) pump.

SUMMARY OF THE INVENTION

According to one aspect of the present invention, an inverted engine has a wet sump lubrication system with a combined sump casing and cylinder head, camshaft or valve gear, cover. Elimination of a separate oil tank and its associated feed supply and recirculatory return pipe-work or plumbing, provides the advantages of an integral oil system, such as an on-board or integral sump. The wet sump system removes the inherent disadvantages of the dry sump arrangement. Thus, it is simpler with fewer parts, pipes, joints, etc., that may fail or leak, and the integration of oil system and engine also creates a single stand-alone package.

Installation issues are significant for the light aircraft market which is sensitive to first cost and ongoing running and maintenance costs and may also use installers with limited skills such as builders of kit aircraft. By combining an inverted engine configuration with the cam shaft in the head and wet sump lubrication according to the present invention, lubricant (oil) in the sump can provide constant lubrication by indirect splash and/or direct immersion to the camshaft lobes. This is particularly important at engine start-up. During normal operation, there will be oil mist/splash lubrication present and so force-feed lubrication of the camshaft and valve train may not be necessary thus simplifying the design.

Another potential problem of non-inverted engines where a camshaft is generally mounted high in the engine, is that the cam lobes and followers can become dry during periods of engine non-use. Critical wear surfaces can thus be scored, scuffed and otherwise damaged due to lack of lubricant at engine start-up. In a wet sump inverted engine according to the present invention, the cam can remain flooded with oil even during long periods of non-use, thus eliminating or minimizing the possibility of dry cam lobes.

Aside from cam-in-head configurations, a similar constant lubrication benefit could be provided for rocker arms and other valve gear components commonly used with push-rod type valve actuation. Advantageously, with a cam-in-head configuration, a rotary oil pump and fittings could be mounted close to the oil sump and integrated with, or coupled to a camshaft drive. Indeed, the pump could be mounted upon the camshaft itself.

A wet sump lubrication system in an inverted engine, according to the invention, can be applied to in-line or V configurations. An engine may be of otherwise conventional design. This aspect of the invention, along with the various other aspects described elsewhere, taken both individually and collectively, are generally compatible with the following: two, or four-stroke combustion cycles; high, or low-mounted camshafts; multiple cylinders; compression- ignition ('diesel') combustion; sparkignition combustion; liquid fuel (e.g. gasoline, kerosene, fuel oil or liquefied petroleum gas); and gaseous fuel.

The engine may also be equipped with a turbo-super-charger or multiple turbo-super-chargers which may be connected in series or parallel. A downstream turbine may be fitted, and geared to provide extra power to the crankshaft (usually known as "turbo-compounding"). A mechanically-driven super-charger, or multiple super-chargers, may be used in the pressure charging system.

BRIEF DESCRIPTION OF THE DRAWINGS

There now follows a description of some particular embodiments of this particular aspect of the invention, by way of example only, with reference to the accompanying diagrammatic and schematic drawing(s), in which.

DESCRIPTION OF THE PREFERRED EMBODIMENT(S)

Figure 1:
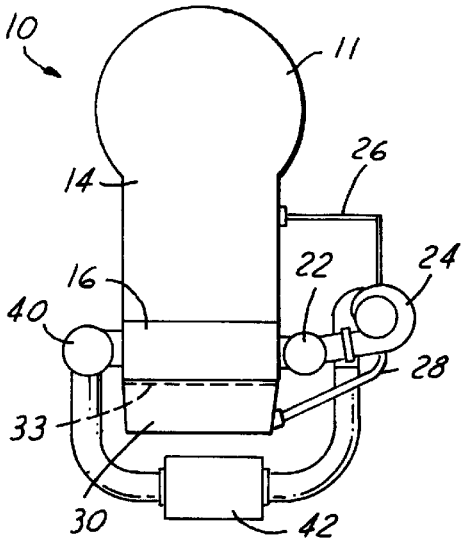
FIG. 1 is a schematic diagram of an inverted engine with a turbocharger in accordance with the present invention.

A primary feature of the present invention concerns the lubricant (oil) storage provision. In that context, the various terms "sump", "wet sump" and "dry sump" have special meanings attributed to them herein and in the context of internal combustion engines.

In established IC engine parlance, the term "sump" generally characterizes an on-board (i.e. engine-mounted) or (engine) integrated chamber, for the collection of lubricant (oil), by a gravity return flow, typically after circulation under pressure by an oil pump. The term "sump" does not embrace any form of reservoir (open, closed, etc.) at whatever orientation, position or level.

In a conventional upright IC engine orientation with a crankshaft at the bottom, the sump is at the bottom of the engine, and forms part of the crankshaft housing. In that situation, lubricant (oil) can drain (passively) under gravity in a return flow to the underlying sump from where it can be collected for recirculation by an engine oil pump.

As used herein and in accepted IC engine parlance, the term, or expression, "wet sump" signifies that the sump not only collects returned oil, but serves as a primary reservoir or store for engine oil. Thus, in practice, a substantial (and generally majority) proportion of a total overall engine oil system capacity is stored in the wet sump, hence the qualifying designation "wet". Typically, a wet sump is integrated with the engine housing.

With an inverted engine, the crankcase is at the top of the engine and a sump located in the conventional position adjacent the crankshaft is not in a position to receive a gravity return flow of oil from all parts of the engine. Thus, conventional inverted engine oil systems employ a "dry sump". In contrast to a wet sump, and again in accepted IC engine parlance, the term, or expression, "dry sump" reflects a temporary collection role of the sump in a gravity return flow of oil, but the sump does not fulfil a long term substantial storage or reservoir role.

In inverted engines, a discrete oil tank, generally apart from the engine (and its engine-mounted dry sump) and connected thereto by umbilical plumbing pipe-work, is used to store (long term) a substantial (again generally the majority) proportion of the total overall oil system capacity. That is, the separate oil tank and not the (engine mounted) sump, fulfills the role of primary (long term or permanent) engine oil reservoir. Hence the sump itself is appropriately qualified by the designation "dry" which is nevertheless a strictly relative term, since some oil is present in the sump, albeit a modest amount compared with a conventional wet sump.

The role of an engine oil pump, when provided, is to draw oil from the main oil reservoir and supply it to the necessary engine parts. Additionally, an oil pump may be provided to transfer, or scavenge, oil from a dry sump and return it to an oil tank.

Notwithstanding the foregoing usage, some engines are known with oil systems which exhibit characteristics of both wet and dry sump systems —and these may be regarded as hybrid or combined systems.

The term "turbocharger" as used herein embraces any form of indirectly, for example exhaust flow turbine, driven flow promoter with or without pressure gain for engine combustion intake. A turbocharger represents a particular category, or variant of super-charger, a term which is commonly used to designate a mechanically-driven intake flow promoter, or compressor. As such, the term turbocharger can be regarded as an abbreviation, or equivalent of, "turbo-supercharger".

The particular engine 10 utilized in the drawings and specification herein is a two-stroke compression-ignition (or diesel) combustion cycle with integral cooling heat exchanger or radiator —and is being used only as an example to explain the key aspects of the present invention. It is to be understood that the present invention can be used with virtually all types of engines which can be used in an inverted manner.

One outward distinguishing feature of this example of the present invention is an integrated sump casing 30 at the bottom of the engine 10. The sump 30 serves as a permanent on-board engine lubricant (oil) reservoir. More specifically, the casing or housing of the sump 30 is secured to a cylinder head 16 at the bottom of the engine, configured and disposed to enshroud the (overhead) cam-shaft or other valve drive gear (not shown).

A normal operational oil level in the sump 30 is indicated by broken line 33 and although subject to fluctuation with maneuvering accelerative loads, this level is generally sufficient to ensure permanent lubrication of the camshaft or other valve gear. A positive pressure or displacement pump lubrication system collects oil from the sump at one or more internal engine collection points and delivers it (actively) to certain key internal engine oil-ways, or galleries, in an internal lubricant oil pathway. This oil pathway feeds more remote engine componentry from which oil progressively returns (passively) under gravity to the sump; the recirculatory cycle being arranged to maintain a consistent level.

Figure 2:
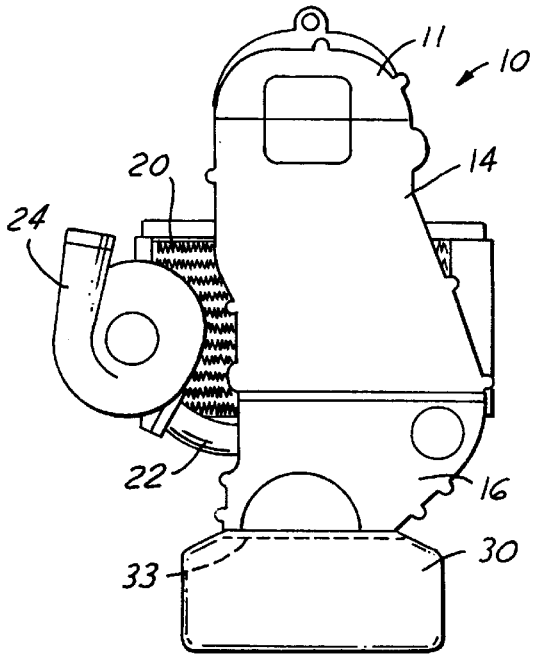
FIG. 2 shows an end elevation of an inverted in-line IC piston engine with a wet sump lubrication system.
Figure 3:
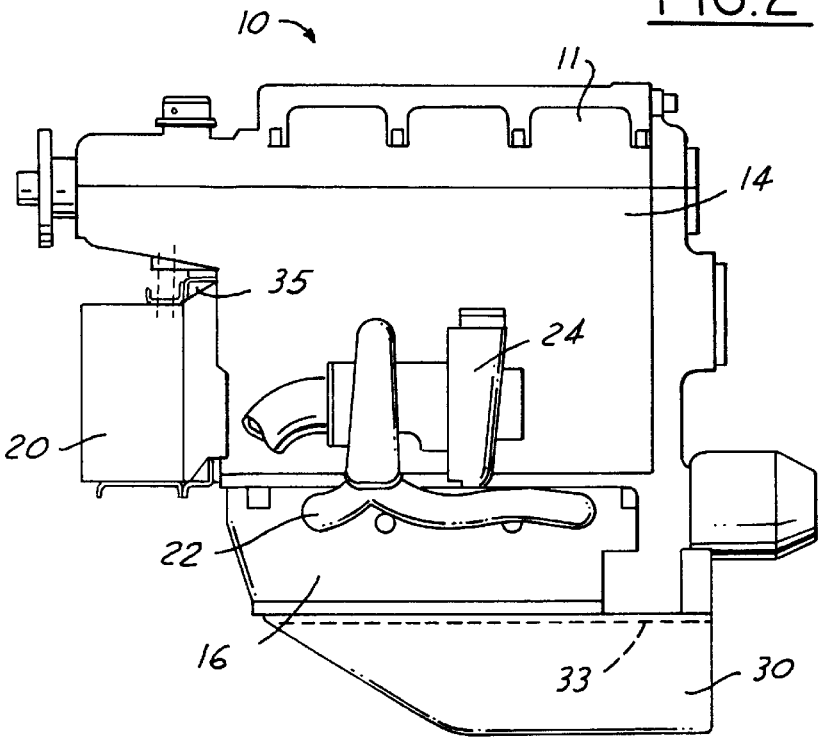
FIG. 3 is a side elevational view of the engine shown in FIG. 2.

Other aspects of the engine are shown in FIGS. 1, 2 and 3. For convenience, the same reference numerals are used for corresponding or equivalent components throughout the drawings.

Many positive displacement (in particular, piston-in-cylinder) IC engines use "turbo-super-chargers" (henceforward referred to as "turbochargers"), for various benefits. An over-riding benefit is an increase in engine airflow. This allows an engine to produce a much greater power than if it were naturally (i.e. unforced) aspirated. Adoption of single or multiple turbochargers is common on many engine types for diverse uses, including automotive, agricultural, commercial, industrial, marine and aviation.

While turbo-supercharging increases engine system complexity, the increase in engine power output and the other benefits, generally outweigh this otherwise significant disadvantage. In addition to connections to the exhaust and air intake systems most turbochargers also require to be supplied with a lubricating fluid, in particular oil. This is usually taken from the engine's own oil system, via small (bore) pipe-work since the quantity required is not great. The oil return to the engine sump is more problematic.

Thus, there is usually some flow of air and exhaust gas past the turbocharger shaft seals, so a drain tube has to cope with this flow of gas, as well as the by now aerated returning oil. If the drain tube is not of sufficient diameter, the turbocharger shaft and seals may become bathed in oil. If so, the pressure in the turbocharger housing may rise and there can be problems with oil leakage, oil carbonization, etc.

For the majority of IC (piston) engines, it is relatively easy to provide oil gravity drainage. This is because most engines are orientated upright, that is with crankshaft lowermost, and cylinder head and exhaust ports uppermost. The turbocharger is attached to an exhaust manifold which is attached to a cylinder head. The turbocharger is thus usually mounted relatively high on the engine. A simple (although relatively large diameter) drain tube can carry used oil back to an integral engine sump at the bottom of the engine. Sometimes difficulties arise in fitting the drain tube because of its large size, but these are rarely insurmountable.

For piston engines with nearly horizontal cylinders, such as are often used on buses (where they are typically mounted under the floor), or on aircraft (where flat four and six cylinder engines are common), turbocharger oil return poses a greater problem. It may not be possible for a simple drain tube to have sufficient angle of inclination (or "fall") to prevent returning oil partially obstructing the flow of frothed oil and blow-by gas. This may cause raised pressure in the turbocharger housing, flooding of the housing, and leakage, carbonization, etc., problems. The level of oil in the engine's sump also may be only slightly lower than the oil drain port on the turbocharger housing which may be at a considerable distance from the sump inhibiting (passive) gravity return.

In considering relative heights or levels, for simplicity engine orientation is referred to as if the aircraft were on its ground landing gear. A gravity drain will not always work under gravity alone, but will also function under accelerated maneuvering loads, but nonetheless provides a simple oil return without pumping or other special provision.

Most aircraft are operated for most of the time in an attitude where the acceleration due to gravity and any acceleration due to maneuvering lie in approximately the same direction, although the accelerations due to maneuvering may add to or subtract from the gravitational acceleration. An aircraft engine that is to be fitted to an airplane that is to fly inverted for a considerable period of time must have special systems and features to cope with this requirement. That said, the present invention is not specifically concerned with such special adaptation for prolonged aerobatic flight modes.

The horizontal (flat) configuration often with the exhaust ports underneath the engine commonly adopted for piston aircraft engines poses particular problems in turbocharger location and mounting. This makes it difficult to mount an exhaust-driven turbocharger in a relatively high position, and still provide turbocharger used oil gravity drainage. For such an aircraft engine installation, the turbocharger is often mounted either below or behind the engine. A supplementary oil pump is then used to scavenge or suck the oil from the turbocharger outlet and return it back to the engine sump or oil tank.

Extra complexity in an engine brings further failure modes and greater risk, which in an aircraft engine is especially undesirable. Also, a long exhaust manifold needs special measures (expansion joints, vibration isolation etc), to insure durability. Moreover, its large internal volume adversely affects turbocharger performance.

According to another aspect of the invention, a turbocharger installation for an inverted IC engine configuration with a wet sump is mounted slightly above an operational lubricant (oil) level in the wet sump. In practice, the turbocharger location may be to one side and/or at one (front or rear) end of the engine. A variety of turbocharger locations may be employed provided generally above the wet sump operational oil level in order to allow a gravity oil return to the sump after turbocharger lubrication.

The inverted engine may be an in-line, V-type etc. configuration where the crankshaft is toward the top of the engine and the cylinder head(s) and valve gear are below it near the bottom.

A turbocharger lubricant (oil) feed is taken from a positive displacement and/or pressure lubricant (oil) pump in an overall engine lubricant recirculatory lubrication system with a (passive) gravity drain return to the wet sump which is itself conveniently integrated with a lower engine casing or housing for a cam-shaft or valve gear. The turbocharger can conveniently be mounted directly upon an exhaust manifold. The manifold itself can be of compact construction. Individual manifold branches are made as short as possible and are desirably shorter than twice the cylinder spacing.

The combination of inverted engine, wet sump close-mounted turbocharger layout according to one embodiment of the present invention affords a considerable safety improvement for a turbo-supercharged aircraft engine. This is primarily due to the reduction in overall complexity, while preserving the respective individual benefits of each component and system. Indeed, overall, the mounting of a turbocharger, with gravity drain, to an under-slung wet sump on an inverted engine is not significantly more difficult than with a conventional (non-inverted) layout as typically used for automotive (truck and car) engines. Other benefits of the present invention include reduced component and installation cost and complexity, the integration of components into an engine package that can be assembled and tested as a stand-alone unit ready for installation in an airframe, ready and rapid engine removal for servicing etc. with a minimum of disturbance to the rest of the airplane, and improved engine performance attendant a small volume exhaust manifold.

In some cases, the general aircraft requirement of light weight may best be satisfied by using a very low weight exhaust manifold incapable of supporting the mass of the turbocharger. In this situation rather than risk structural failure of the manifold or increase engine weight by strengthening the manifold, it may be advantageous to support the turbocharger upon a separate bracket. Slip-joints, flexible pipes, or some other means of providing flexibility could then be used in order to ensure that the bracket only carries structural loads and is not exposed to additional loading due to thermal growth. In this manner, thin-wall tubing may be used for a light-weight manifold with reduced risk of cracking.

Referring again to the drawings, an inverted IC piston engine 10 includes a crankcase 11 surrounding a crankshaft (not shown), a cylinder block 14, cylinder head 16, and radiator 20. An exhaust manifold 22, is mounted upon the cylinder head 16 and a turbocharger 24 is mounted upon the exhaust manifold 22.

The turbocharger 24 is supplied with lubricant (oil) through a feed line 26 from the delivery or output side of a dedicated (conveniently directly engine-driven) lubricant pump (not shown), in a recirculatory lubricant (oil) path including an integral underslung permanent oil supply reservoir or (wet) sump 30. The turbocharger 24 is positioned, in accordance with one embodiment of the present invention at a level above the operational lubricant (oil) level indicated by broken line 33 in the sump 30 to allow such (passive) gravity lubricant (oil) return. The sump 30 casing serves as a combined cylinder-head (camshaft or rocker gear) cover and is effectively integrated with part of the engine housing or casing. In the recirculatory return flow, lubricant (oil) drains under gravity (and/or maneuvering accelerations) through a drain line 28 of somewhat larger bore diameter than the feed line 26 to the sump 30.

Also shown in FIG. 1 is an "after-cooler" (sometimes called an 'inter-cooler') 42 connected between a turbocharger flow enhancement or compressor stage 24 and an engine inlet manifold 40. The position, height or level and orientation of the after-cooler 42 can be varied in relation to the engine 10. Similarly, additional turbochargers, intercoolers, etc. may be included, as required.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. An inverted piston engine comprising a wet sump, a wet sump lubrication system containing a lubricant, a cylinder-head, an exhaust manifold, a turbocharger attached to said exhaust manifold, said turbocharger being positioned adjacent said cylinder head and above said wet sump, an oil pump for supplying lubricant to said turbocharger and a lubricant return means, wherein lubricant supplied to said turbocharger is returned by gravity to said wet sump.

2. The inverted engine as set forth in claim 1 further comprising an in-head camshaft and wherein said camshaft is lubricated by lubricant entrained within said wet sump.

3. The inverted engine as set forth in claim 2 further comprising a rotary lubricant pump driven by said camshaft.

4. The inverted engine as set forth in claim 1 further comprising multiple rows of cylinder in said cylinder head.

5. The inverted engine as set forth in claim 1 wherein said turbocharger is mounted on a side of the engine.

6. The inverted engine as set forth in claim 1 wherein said turbocharger is mounted on an end of the engine.

7. The inverted engine as set forth in claim 1 wherein said turbocharger is at least partially supported by an exhaust manifold.

8. The inverted engine as set forth in claim 1 further comprising a bracket member and wherein said turbocharger is at least partially supported by said bracket member independent of said exhaust manifold.

9. The inverted engine as set forth in claim 1 wherein said exhaust manifold is a multiple branch exhaust manifold, the individual branch length of said manifold being less than twice the spacing of cylinders in said cylinder head.

10. The inverted engine as set forth in claim 1 wherein said engine is at least partially liquid cooled.

11. The inverted engine as set forth in claim 1 wherein said engine is at least partial air cooled.

12. The inverted engine as set forth in claim 1 wherein said engine is a two-stroke combustion cycle engine.

13. The inverted engine as set forth in claim 1 wherein said engine is a four-stroke combustion cycle engine.

14. The inverted engine as set forth in claim 1 wherein said engine is an in-line engine.

15. The inverted engine as set forth in claim 1 wherein said engine has at least one mutuallyinclined bank of cylinders.

16. The inverted engine as set forth in claim 1 further comprising an aircraft and said engine is mounted in said aircraft.

* * * * *